US011246787B2

(12) United States Patent
Lince et al.

(10) Patent No.: US 11,246,787 B2
(45) Date of Patent: Feb. 15, 2022

(54) BI-DIRECTIONAL UNDERACTUATED EXOSKELETON

(71) Applicants: Fondazione Istituto Italiano Di Tecnologia, Genoa (IT); Politecnico Di Torino, Turin (IT)

(72) Inventors: Andrea Lince, Genoa (IT); Alessandro Battezzato, Turin (IT); Nicolo Celadon, Genoa (IT); Silvia Appendino, Genoa (IT); Alain Favetto, Genoa (IT); Marco Paleari, Genoa (IT); Paolo Ariano, Genoa (IT)

(73) Assignee: FONDAZIONE ISTITUTO ITALIANO DI TECNOLOGIA, Genoa (IT)

( * ) Notice: Subject to any disclaimer, the term of this patent is extended or adjusted under 35 U.S.C. 154(b) by 755 days.

(21) Appl. No.: 16/097,601

(22) PCT Filed: Apr. 13, 2017

(86) PCT No.: PCT/IB2017/052138
§ 371 (c)(1),
(2) Date: Oct. 29, 2018

(87) PCT Pub. No.: WO2017/187288
PCT Pub. Date: Nov. 2, 2017

(65) Prior Publication Data

US 2019/0151181 A1 May 23, 2019

(30) Foreign Application Priority Data

Apr. 29, 2016 (IT) ..... 102016000044002

(51) Int. Cl.
*A61H 1/02* (2006.01)

(52) U.S. Cl.
CPC ..... *A61H 1/0288* (2013.01); *A61H 2201/123* (2013.01); *A61H 2201/1215* (2013.01);
(Continued)

(58) Field of Classification Search
CPC ..... A61H 1/0288; A61H 1/0285; A61H 2201/1635; A61H 2205/065; A61H 2205/067
See application file for complete search history.

(56) References Cited

U.S. PATENT DOCUMENTS

2013/0261514 A1 10/2013 Tsui

FOREIGN PATENT DOCUMENTS

JP 2008-067852 A 3/2008
WO 1995/010396 A1 4/1995
(Continued)

OTHER PUBLICATIONS

Notification of Transmittal of the International Search Report and the Written Opinion of the International Searching Authority for PCT/IB2017/052138 dated Aug. 9, 2017.
(Continued)

*Primary Examiner* — Jan Christopher L Merene
*Assistant Examiner* — Cana A Gallegos
(74) *Attorney, Agent, or Firm* — Hedman & Costigan, P.C.; James V. Costigan; Kathleen A. Costigan

(57) ABSTRACT

The present invention relates to a wearable actuation device (1) for the assisted movement of the fingers of a user's hand, comprising a supporting platform (10), intended to be positioned on the back of the hand and provided with fixing means for wearing in a removable way the device (1) on the hand. The device also comprises at least an articulated first finger module (2), connected with one end to the supporting platform (10) and suitable to be positioned and connected to a finger of the hand for guiding a movement of flexion or
(Continued)

extension of the finger itself, and a motor (11) provided with an output shaft, supported by the supporting platform (10) and suitable to generate a rotational motion in two opposite directions of the motor shaft (11). The device (1) also comprises first transmission means of the first finger module (2) to allow an actuation at least of the first finger module (2).

10 Claims, 5 Drawing Sheets

(52) U.S. Cl.
CPC .. *A61H 2201/149* (2013.01); *A61H 2201/165* (2013.01); *A61H 2201/1638* (2013.01); *A61H 2201/1666* (2013.01); *A61H 2201/1673* (2013.01)

(56) References Cited

FOREIGN PATENT DOCUMENTS

| | | | |
|---|---|---|---|
| WO | 2009/016478 | A2 | 2/2009 |
| WO | 2009/016478 | A8 | 9/2009 |
| WO | 2009/016478 | A3 | 6/2010 |
| WO | 2015/095459 | A1 | 6/2015 |

OTHER PUBLICATIONS

English Abstract for JP 2008-067852 A dated Mar. 27, 2008.
A. Chiri et al., Handexos: Towards a Support Device for Hand Activities and Telepresence, Nov. 10, 2008-Nov. 1, 2008, retrieved from the Internet URL:http://robotics.estec.esa.int/ASTRA/Astra2008/S07/07_01_Chirri.pdf, retrieved on Apr. 2, 2015.
Cesare Rossi, and Sergio Savino, An Underactuated Multi-finger Grasping Device, International Journal of Advanced Robotic Systems, 2014.
Alessandro Battezzato, Kinetostatic Analysis and Design Optimization of an N-Finger Underactuated Hand Exoskeleton, Mechanism and Machine Theory, 2015, pp. 86-104, vol. 88.

BI-DIRECTIONAL UNDERACTUATED EXOSKELETON

TECHNICAL FIELD

The present invention relates to the field of mechatronics, in particular to exoskeletons used to assist human movements.

The present invention relates, in particular, to exoskeletons wearable on one hand according to the preamble of claim 1.

PRIOR ART

Traditional exoskeletons, and in particular exoskeletons that assist the upper limbs, such as for example hands, are wearable devices by a user, and that provide for an actuation system suitable of generating a force to be transmitted to the fingers, in order to allow the closing or opening of the hand.

It should be noted from now on that these devices are deeply different—both conceptually, and for their purposes—from the hands of robots, which exclude from the presence of the human limb.

In the reference field, among the known solutions, one of the main issues resides in the actuation of such devices.

In fact, if all degrees of freedom (DOF) of the hand are actively assisted both during the opening and the closing of the fingers, the number of actuators and the mechanical complexity of the device are very high.

A particularly interesting type of exoskeletons, to which the present invention is addressed, relates to "under actuated" exoskeletons for hands.

As it can be easily understood, the most relevant issue relates to having to transmit—in order to get an optimal operation—a bidirectional force to each finger of the hand, so as to allow the extension and flexion movements of the same.

Traditionally, there are two ways to meet such requirement:

the first one consists in transmitting force and movement through rigid connections, but has the drawback of great overall size and weight, and is therefore poorly adapted to portable and wearable devices;

the second one involves the use of passive elements (e.g. springs) in order to assist one of the two phases (usually the opening phase), but this means that the motor must be oversized, as it must overcome the force of the spring during the active phase; furthermore a force modulation and a precise control during the passive phase are lacking, in which the springs are working.

An example of a known exoskeleton, as described above, is shown from the US Patent application US 2013/0261514 A1 that discloses an exoskeleton for the motion rehabilitation of the hand equipped with a bidirectional actuation system of the fingers, that is, which is capable of actively assisting both the closing and the opening of the hand. Such solution provides an actuator for each finger and pressure/force sensors positioned on the phalanges of the fingers, so that when these latter exert a force, for example in order to grasp an object, the device detects it and each actuator actuates a corresponding mechanical finger in order to assist the human one.

The main drawback of this solution is, in fact, due to the high cost and structural complexity of the device, as it needs a plurality of sensors, connections and conditioning circuits, and a control logic for each actuator. Moreover, the presence of a separate control logics for each finger makes the distribution of the forces to be applied to each of them difficult to control, resulting in a reduced coordination among the fingers and scarcely efficient opening and closing movements of the hand. A solution that reduces some of the drawbacks present in the actuator known from US 2013/0261514 A1, is described in the publication "International Journal of Advanced Robotic Systems, "An Under actuated Multi-finger Grasping Device" (Cesare Rossi and Sergio Savino, date of publication 15 Oct. 2013)". Such publication describes a multi-finger device for grasping objects, equipped with a single actuator that provides the force to the totality of the mechanical fingers of the device, and of a structure that, through a mechanical cable/pulley system, allows to obtain a movement of the fingers of one hand in a synergistic and adaptive way.

Although such solution has reduced size and weight, it provides for a structure that does not allow to actively assist both the opening and the closing of the hand. Another known solution is described in A. Battezzato, "Kinetostatic analysis and design optimization of an n-finger under actuated hand exoskeleton", Mechanisms and Machine Theory, vol. 88, pp. 86-104, 2015: this solution—even interesting—is suitable to assist only the closing of the hand and therefore it cannot be used in the rehabilitation process; the opening of the hand must in fact be made either by the user himself or by means of springs or return elements, with the drawbacks described above.

A further known solution is described in WO 2015/095459 A1 that includes an exoskeleton for a finger comprising a plurality of articulated joints and sensors configured to measure the rotation of said articulated joints. The exoskeleton for the finger also comprises a sequential elastic actuator comprising a spring.

The sequential elastic actuator is configured to rotate at least one of said joints. Moreover, the exoskeleton for the finger comprises a processing device configured to control the operation of the elastic actuator based at least on a pair of joints, such pair being determined by the spring and the rotation of said plurality of joints. The document also describes a method and an exoskeleton for the hand.

Another known solution is disclosed in WO 95/10396 A1 that describes a device able to provide a feedback force to a physiological unit, which can be used as an advanced interface for machines and computers, including an exoskeleton with kinematic elements articulated around articulation axes arranged coinciding with, or in proximity of, the physiological axes of the physiological unit, such as, for example, the flexion-extension axes of the phalanges of the fingers of a hand of an operator. A series of electric actuators controls the degree of voltage on the traction cables by applying a feedback force to the kinematic elements and, as consequence, to the physiological unit, so as to simulate the interaction between the operator and a virtual object. The device also comprises position sensors for the detection of the physiological unit configuration and pressure sensors for measuring the intensity of the force locally applied by actuators controlled by a processing system.

Another known solution is the scientific publication of A. CHIRI et al. "Handexos: Towards a support device for hand activities and telepresence" that describes a new exoskeleton device (Handexos) for the rehabilitation of the hand of post-stroke patients. The modified hand functionality can be synthesized within a limited extension, abduction and adduction, leaving the fingers in a flexed position. The purpose of the device is therefore to create a safety extension movement from the typically closed position of the damaged hand.

The mechanical design of the device offers the ability to overcome the limits of exoskeletons often associated with the overall high complexity of the structure, of the mechanism and of the actuation. Moreover, by way of example, the mechanical design of an index finger module, a dynamic pattern and some preliminary experimental results, are described.

OBJECTS AND SUMMARY OF THE INVENTION

The object of the present invention is to overcome the drawbacks of the known art. In particular, an object of the present invention is to provide a wearable actuation device for the assisted handling of the fingers of one hand that, when actuated by a single motor, allows an operational reversibility to assist both the opening and closing of the fingers.

It is also an object of the present invention to provide an actuation device wearable on one hand, which is compact.

These and other object of the present invention are achieved by means of an actuation device wearable on one hand incorporating the characteristics of the appended claims, which form an integral part of the present description. The idea underlying the present invention is to provide a wearable actuation device, for the assisted movement of the fingers of one hand of a user, comprising a supporting platform to be placed on the back of the hand and provided with fastening means for removably wearing the device on the hand. The device further comprises at least one articulated first finger module, connected with one end to the supporting platform and suitable to be positioned and connected to a finger of the hand, in order to guide a flexion or extension movement of the finger itself, and a motor, provided with an output shaft, supported by the supporting platform and suitable to generate a rotation motion in two opposite directions of the motor shaft.

The device also comprises first transmission means of the first finger module, in order to allow an actuation at least of the first finger module, wherein the first transmission means comprise a first movable member, displaceable at least in translation in two opposite directions, and an actuation flexible element coupled to the movable member and wrapped onto a motor pulley connected to the motor shaft. In particular, the actuation flexible element is coupled to the first movable member in order to move the same in two opposite directions according to the rotation direction of the motor shaft, and the first transmission means also include at least a pair of cables formed by a main cable and a return cable, both coupled at one end thereof to the first finger module, and at their other end to the first movable member. Such coupling is made in such a way that to a translation in a direction of the first movable member corresponds a movement of the main cable and/or of the return cable to which corresponds the flexion or extension actuation of the first finger module, depending on the rotation direction of the motor shaft.

Such solution allows to obtain the operational reversibility of an actuation device for the assisted movement of the fingers of a user's hand that, actuated by a single motor, allows to actively assist both the opening and closing of the fingers. As a matter of fact, the use of a movable member able to translate in a direction depending on the rotation direction of the motor shaft, and the presence of a pair of cables—a main one and a return one—each bound to the movable member and to a finger module, allows to the transmission means of the device to transmit a flexion or an extension force to the finger module according to the rotation direction of the motor.

In a preferred embodiment, the first transmission means also comprise a return pulley around which the actuation flexible element is wrapped, and the first movable member is secured by opposite parts to the actuation flexible element, so as to be moved in one or another direction according to the rotation direction of the motor pulley.

Such solution permits to obtain a device for the assisted movement of the fingers of one hand, which is compact, since, thanks to the use of a return pulley on which the actuation flexible element is wrapped, it is possible to reduce the size of the transmission means being able to orientate with suitable directions the main and return cables in smaller spaces.

Further advantageous features of the present invention will become more evident from the following description and the appended claims, which form an integral part of the present invention.

BRIEF DESCRIPTION OF THE DRAWINGS

The invention will be described hereinbelow with reference to non-limiting examples, by way of illustrative and non-limiting example in the attached drawings. These drawings illustrate different aspects and embodiments of the present invention and, where appropriate, reference numbers illustrating similar structures, components, materials and/or items in different figures, are denoted with similar reference numbers.

DETAILED DESCRIPTION OF THE INVENTION

While the invention is susceptible to various modifications and alternative constructions, some non-limiting embodiments, given by way of example, are described in detail hereinbelow.

It should be understood, however, that there is no intention of limiting the invention to the illustrated specific embodiments, but, conversely, the invention intends to cover all the modifications, alternative constructions and equivalents falling within the scope of the invention as defined in the claims.

In the following description, therefore, the use of "for example", "etc.", "or" denotes non-exclusive alternatives without any limitation, unless otherwise indicated; the use of "also" means "among the others, but not limited to" if not differently indicated; the use of "includes/comprises" means "includes/comprises, but it is not limited to", unless otherwise indicated.

Figure 1:
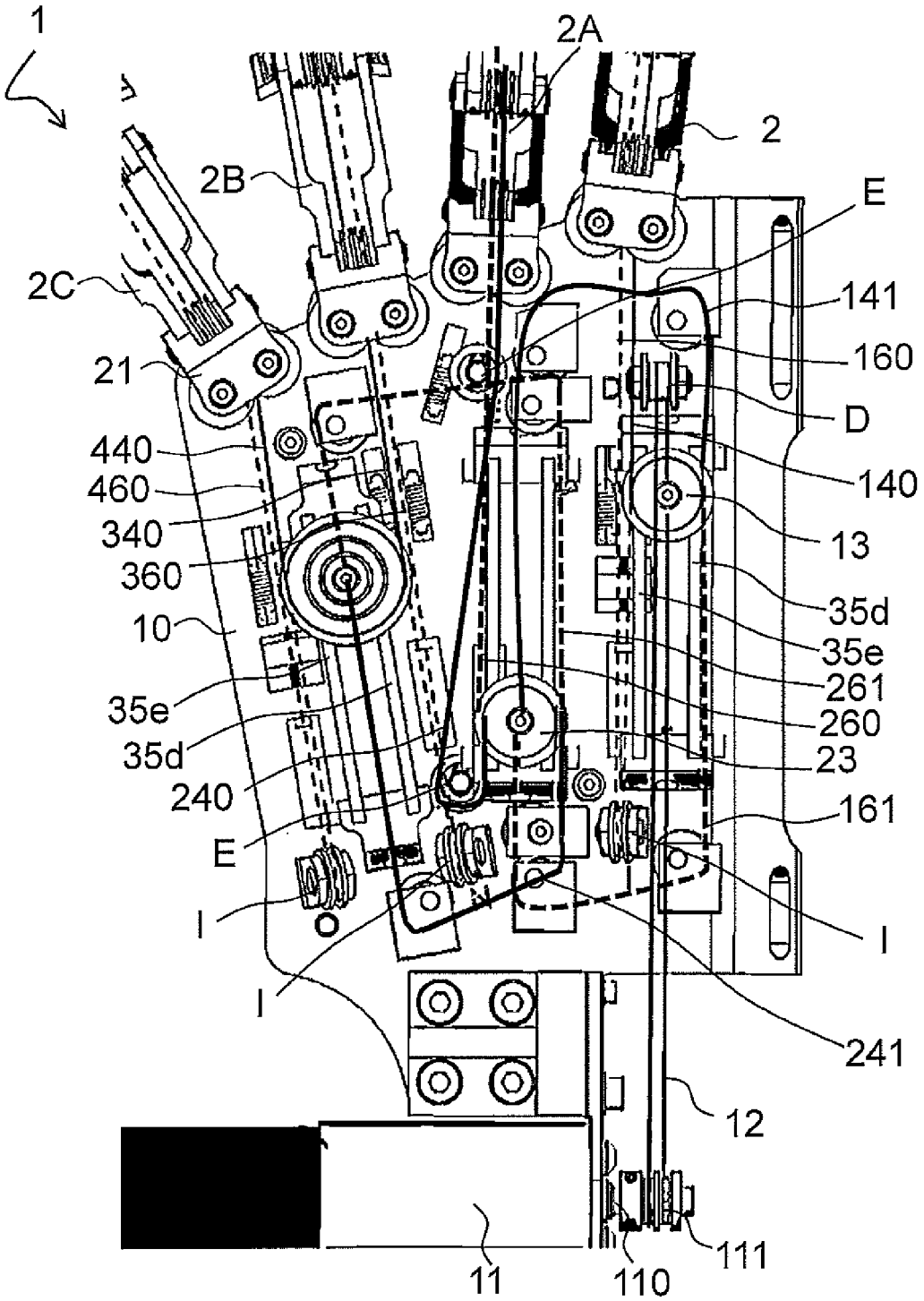
FIG. 1 shows a top view of a first detail—the supporting platform—of the actuation device according to the invention.

FIG. 1 shows a top view of a first detail—the supporting platform 10—of an wearable actuation device 1 in a preferred embodiment that allows the assisted movement of one hand.

In general terms, the device 1 comprises a single motor 11 attached to the supporting platform 10, and transmission means suitable to transmit the motion generated by the motor to a plurality of finger modules (2, 2A, 2B, 2C)—partially visible in FIG. 1. Each of the finger modules is connected, preferably in an articulated manner, with one end 21 to the supporting platform 10 and is able to be positioned onto a finger of a user's hand.

The supporting platform 10 forms a real frame having a substantially planar or plate-shaped structure, on which components of the device 1 are fixed, which will be described later, and is provided with fastening means for wearing in a removable way the device 1 on the hand. In particular, when in use, it is positioned on the back of the user's hand, and fixed thereto through removable fastening means, for example, in a preferred embodiment at least one, preferably two or more hooks and eyelets (for example, those also known with the tradename VELCRO) not shown in the Figures; it is evident that, in an equivalent way, textile strips with closure buckles or the like can be used.

The bottom of the platform 10 (that is, the surface of the latter intended—when in use—to face the user's hand) is preferably molded in an anatomical way, to fit the back of the hand. To this end, it may be equipped with a soft and flexible material, such as foam rubber, that is applied to give the user a greater comfort.

Although not being a strict requirement for the purposes of the present invention, in one embodiment the supporting platform 10 is preferably made by means of three-dimensional or 3D plastic printing technique, this latter feature permitting to limit the weight of the device 1 and to allow a large degree of customization for the user who has to wear it, and has such dimensions that it does not exceed the surface of the back of the hand.

On the supporting platform 10 the motor 11 is fixed, preferably a direct current brushless electric motor.

To the motor 11, suitably powered by an electric power source (e.g. an electric battery) a rotating output shaft 110 is coupled, which, depending on the rotation direction of the motor, rotates in one direction or another, having thus in conclusion a reversible rotational motion.

To the motor 11 transmission means are connected for transmitting the motion (generated by the motor 11) to the plurality of finger modules (2, 2A, 2B, 2C).

Figure 2:
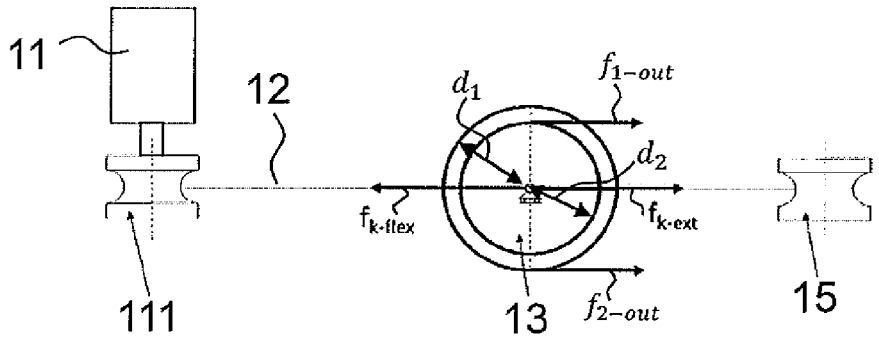
FIGS. 2, 3 and 4 each illustrate an exemplary scheme of the principle of operation of the transmission means of the actuation device according to the invention.

In particular, on the shaft 110 a motor pulley 111 is mounted, which is coupled to an actuation flexible element, i.e. the cable 12, on which a movable member 13 is fixed. For more detail and better understanding of components and interconnections of the transmission means, with reference to FIGS. 2, 3 and 4, exemplary schemes are illustrated of the operative principle of the transmission means of the actuation device 1.

Preferably, and in the embodiments described in the Figures, the movable member 13 is a pulley, and in the embodiment illustrated the pulley which makes the movable member 13 is connected at its rotation center with the cable 12.

The movable member 13 can thus move along a parallel direction (and, at most, coincident) to the direction of application of an input force ($f_{k\text{-}flex}$, $f_{k\text{-}ext}$) given by the rotational motion of motor 11 and transmitted along the cable 12, and can rotate around its own axis. The movable member 13 allows to divide the input force ($f_{k\text{-}flex}$, $f_{k\text{-}ext}$) in at least two outputs ($f_{1\text{-}out}$, $f_{2\text{-}out}$), and preferably has two disks having surfaces of different radiuses ($d_1$, $d_2$), so as to obtain different force values for each output ($f_{1\text{-}out}$, $f_{2\text{-}out}$).

The cable 12, on which the movable member 13 is fastened, is further coupled to one return pulley 15, so that the cable 12 is wound on the motor pulley 111 and on the return pulley 15 by forming a closed circuit. In this way, following a motion of the cable 12 an equivalent translation of the movable member 13 corresponds, in a direction depending on the rotation direction of the motor 11.

Depending on the translation direction of the movable member 13, and according to what will be better described below, a flexion or extension will correspond of each of the plurality of finger modules (2, 2A, 2B, 2C).

Figure 3:
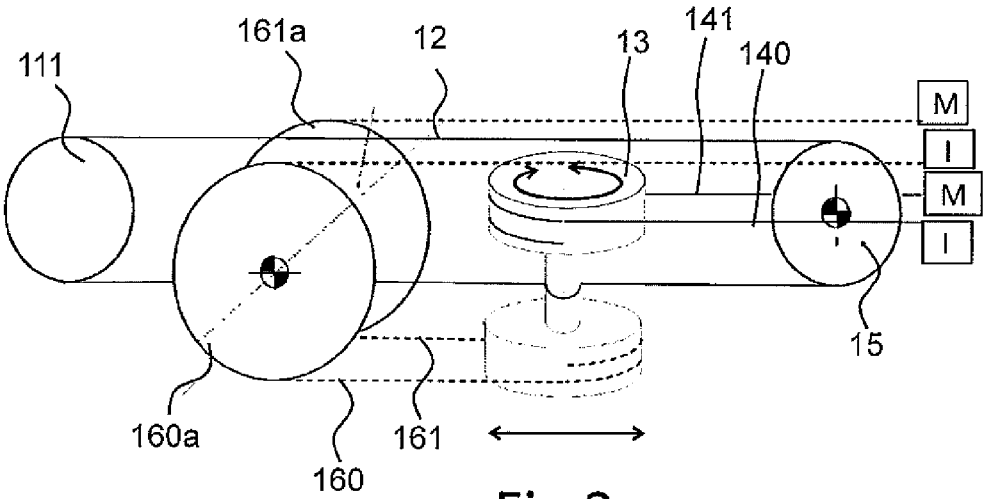
Figure 5A:
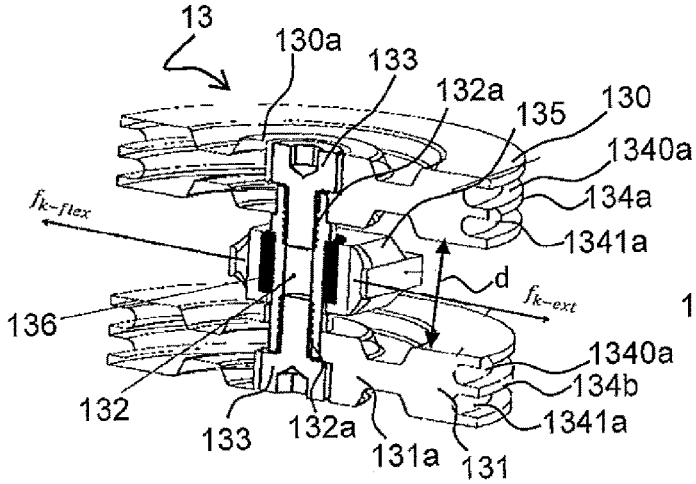
FIGS. 5*a* and 5*b* illustrate respectively a second detail—the movable member—of the actuation device according to the invention, and an enlarged constructive detail of FIG. 5*a;*
Figure 5B:
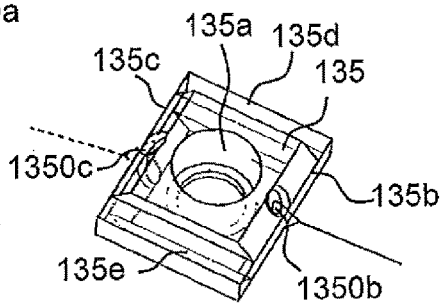

Referring to FIGS. 3, 5*a* and 5*b*, the movable member 13 comprises an upper pulley 130 and a lower pulley 131 that are parallel, spaced apart for a distance d and axially connected by a pin 132, which allows a synchronous rotation thereof. Both the upper pulley 130 and the lower pulley 131 are integrally connected to pin 132 through a corresponding threaded element and through a shape coupling 133 and they provided with corresponding guides (134*a*, 134*b*), suitable for accommodating a main cable (140, 141) and a return cable (160, 161) respectively.

The main cable and the return cable are wrapped around the corresponding pulley, so that, depending on the translation direction of the movable member 13, this corresponds to a flexion or extension movement of one or more of the plurality of finger modules (2, 2A, 2B, 2C).

The corresponding threaded elements 133, on the other hand, by engaging a corresponding seat 132*a* obtained on the pin 132, step retain a corresponding central portion (130*a*, 131*a*) of the upper pulley 130 and lower pulley 131.

At the distance d, centrally positioned with respect thereto, on the pin 132 a slider 135 is mounted that is a prismatic element having a substantially rectangular section, and centrally having a through hole 135*a* to allow the pin 132 to be inserted.

Between the pin 132 and the walls of the through hole 135*a* a sliding bearing 136, for example a bushing, is interposed to allow a relative rotation of the pin 132, and hence of the pulleys (130, 131), with respect to the slider 135. This latter one also has on each of two mutual opposite sides (135*b*, 135*c*), a corresponding hole (1350*b*, 1350*c*) to enable the fastening of cable 12 wrapped on the motor pulley 111 and on the return pulley 15. In this way, the slider 135 can be pulled at its ends by the cable 12. Preferably—and also with reference to FIG. 1—on each of the remaining two opposite sides (135*d*, 135*e*) of the slider 135, a portion protrudes engaging a corresponding track (35*d*, 35*e*) made on the supporting platform 10, in such a way to allow a guided translation of the movable member 13. In order to reduce the effect of dynamic and static friction on the sides of the slider 135 engaging the tracks during the translation of the movable member 13, the slider 135 is preferably made of a low friction polymer material.

The scheme illustrated in FIG. 3 exemplifies a simplified configuration of an example of the realization of the transmission means only providing the handling of two finger modules. In this scheme, and with further reference to FIG. 5*a*, the upper pulley 130 is provided with two grooves (1340*a*, 1341*a*) each capable to house a main cable 140 and a secondary cable 141 respectively, and the lower pulley 131 is provided with two further grooves (1340*b*, 1341*b*), each of them housing a first 160 and a second 161 return cable respectively.

The first cable 140 and the first return cable 160 are bound to a first finger module I, while the second cable 141 and the second return cable 161 are bound to a second finger module M. Furthermore, the first 160 and second 161 return cables are each wrapped around a corresponding idle pulley element (160*a*, 161*a*), and this latter allows to maintain the longitudinal size of the device 1, since in general it is an element that allows to set the direction and the handling of the cables in reduced spaces.

In this way, according to the direction of translation of the movable member 13, there are alternatively present either the flexion of the first finger module I or of the second finger module M, respectively thanks to the motion of the main cable 140 and of the second return cable 141, or the extension of the first finger module I and of the second finger module M, respectively thanks to the motion of the main cable 160 and of the second return cable 161.

Figure 4:
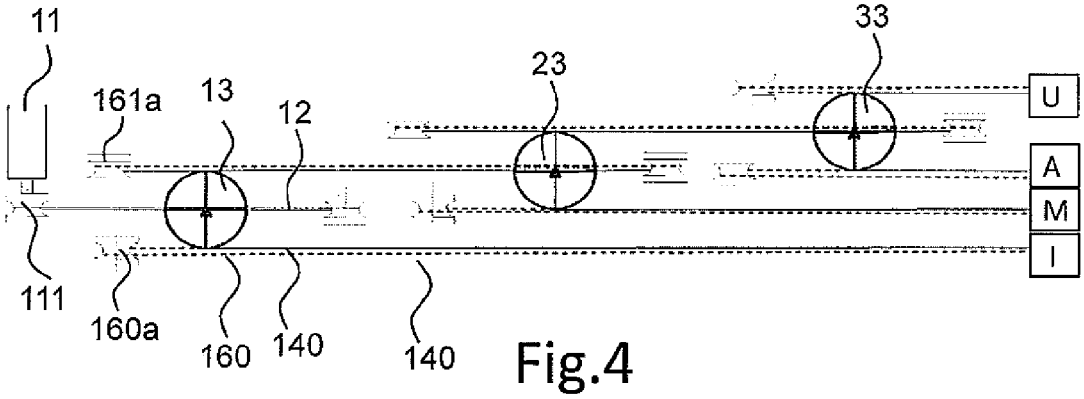

More generally, the operating principle of the transmission means of the device 1 is illustrated in the scheme of FIG. 4, which exemplifies a configuration of these latter, involving the movement of four finger modules (2, 2A, 2B, 2C). It is appropriate to underline that this configuration is equally applicable to a plurality of finger modules greater than or equal to two.

In this case, the first cable 140 and the first return cable 160 of the movable member 13 are bound to a first finger module 2, while the secondary cable 141 and the second return cable 161 are fixed to a slider of a second movable member 23, this latter being connected to a second finger module 2A. In this way, a translation of the movable member 13 involves a translation of the second movable member 23, to which corresponds a flexion or extension movement of the first 2 and second 2A finger modules of the plurality of finger modules.

Similarly, the second movable member 23 is connected to a third movable member 33, and the translation of the second movable member 23 allows a translation of the third movable member 33. The third movable member 33 is in turn connected to two finger modules (shown in FIGS. 2B and 2C), in particular through a corresponding pair of cables, each destined to the flexion or extension of a corresponding finger module.

Therefore, according to the direction of rotation of the motor 11, to a translation of the movable member 13 corresponds a movement in series of further movable members (23, 33) and of idle pulleys which allow the flexion or extension of all four finger modules (2, 2A, 2B, 2C) connected with the supporting platform 10.

Preferably, the radiuses of the upper 130 and lower 131 pulley of each movable member (13, 23, 33) are optimized in order to obtain a specific distribution of the input force ($f_{k\text{-}flex}$, $f_{k\text{-}ext}$) generated by the motor 11 and transmitted to the cable 12. In particular, such distribution provides that 50% of the input force generated by the motor is transmitted to the first finger module 2, 25% of the input force is transmitted to the second finger module 2A, while 12.5% of the input force is transmitted to each one of the third 2B and fourth 2C finger module.

It should be pointed out that the movable members (13, 23, 33), although they may have different dimensions of the radiuses of the upper and lower pulley, have a similar structure, consisting of an upper pulley and a lower pulley, each provided with two guides, and connected through a shaft that is free to rotate inside a slider allowing the translation of the movable member.

Figure 6A:
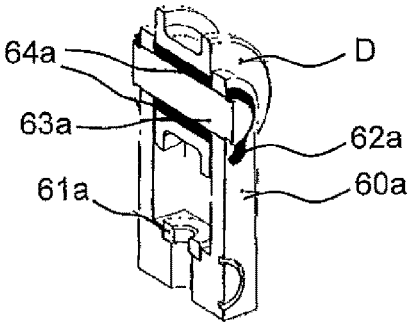
FIGS. 6*a*, 6*b* and 6*c* each illustrate a split view of different realization types a third constructive detail—the return pulley—of the actuation device according to the invention.

Returning to FIG. 1, the routing of the transmission means follows a path that starts from the motor pulley 111 that, by rotating, actuates the cable 12. The cable 12 is fastened on the slider of the movable member 13, and therefore this latter is pulled or pushed along the tracks (35*d*, 35*e*) depending on to the rotation direction of the motor pulley 111. The cable 12 is further wrapped around the idle pulley (D), whose structure is illustrated in FIG. 6*a*.

The pulley D has a support structure 60*a*, preferably made of a 3D plastic printing, which is connected to the platform 10 with a screw 61*a*. Two Seeger rings 62*a* block a shaft 63*a* in axial position and arranged parallel with respect to the plane of the platform 10. The shaft 63*a* is made of metal alloy, and between the pulley D and the shaft 63*a* around which the latter rotates, two bushings 64*a* are interposed.

Assuming for example that the movable member 13 is pulled—but similar and specular considerations could be made by inverting the rotation direction of the motor pulley 111—the cable 140 coupled with a first guide of the upper pulley 130 of the movable member 13, and bound to the first finger module 2, is moved and allows the flexion of this latter.

Consequently, the cable 141 is moved, coupled with a second guide of the upper pulley 130 of the movable member 13, and it is fixed to the slider of the second movable member 23. In this way, the second movable member 23 is pulled and translates along the corresponding guides, approaching the second finger module 2A. The upper pulley of the second movable member 23 is in turn coupled to the cable 240 and to the cable 241: the cable 240 is wrapped around an idle pulley with a "plate-shaped" structure (denoted with E) that transfers it to the second finger module 2A to which it is bound; the cable 241 on the other hand, thanks to further idle pulleys, is directed towards the third movable member 33, and it is fixed to the slider of this latter.

Figure 6B:
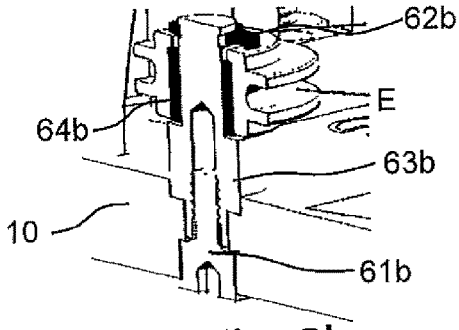

The idle pulley E with a "plate-shaped" structure is shown in FIG. 6*b*, and it provides for a metal shaft 63*b*, around which the pulley E rotates, and between which a bushing 64*b* is interposed, in order to reduce the rotation friction between them. The shaft 63*b* is orthogonally placed to the plane of the supporting platform 10 and it is fastened on this latter, with a screw 61*b*. A Seeger ring 62*b*, placed on one end of the shaft 63*b*, blocks the axial sliding of the pulley E.

The upper pulley of the third movable member 33 is therefore coupled with a pair of cables (340, 440), each being bound to the third 2B and to the fourth 2C finger module respectively.

To the translation of the second movable member 23 hence corresponds a translation in the opposite direction of the third movable member 33, and the motion of the cables (340, 440) allows the flexion of the third 2B and fourth 2C finger module.

The cable 141 and the cable 241, i.e. those fastended to the sliders of the second 23 and third 33 movable members respectively, have a corresponding return cable (161, 261) coupled at one end respectively to the lower pulley of the movable member 13 and of the second movable member 23, and with the other end respectively to the slider of the second 23 and of the fourth 33 movable member.

The cable 140 and the cable 240 also provide for a corresponding return cable (160, 260), coupled with an end, respectively to the lower pulley of the movable member 13 and to the lower pulley of the second movable member 23, and with the other end respectively to the first 2 and the second 2A finger module. In particular, the return cable 160 is further wrapped, in a length comprised between its ends, on an idle pulley with an inclined structure (denoted in the Figure with I), which transfers the same to the first finger module 2.

In the same way, also the cables (340, 440) have a corresponding return cable (360, 460), both coupled with an end to the lower pulley of the third movable member 33 and with the other end respectively to the third 2B and to the fourth 2C finger module. Also in this case, each of the return cables (360, 460) are further wrapped, in a length comprised between their ends, on a corresponding idle pulley with an inclined structure (denoted with I), which transfers the same respectively to the third 2B and to the fourth 2C finger module.

Figure 6C:
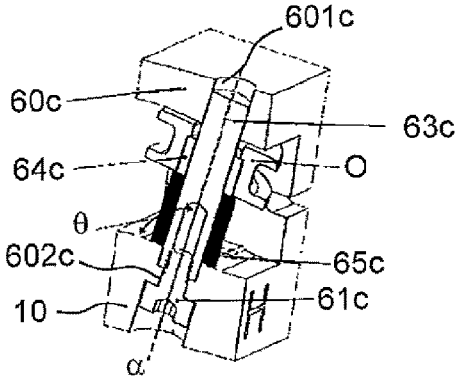

The idle pulley with an inclined structure I is shown in FIG. 6*c* and provides for a support 60*c*, made in such a way to allow the return of a return cable at an adjustable height with respect to the platform 10, and therefore it could be unwound on different levels.

The support 60*c* is a structure preferably made of plastic material, and comprises two seats (601*c*, 602*c*), each able to house a corresponding end of a metal shaft 63*c*. On the shaft 63*c* rotates the pulley O, and it is fixed to the support platform 10 by means of a screw 61*c*.

A bushing 64*c* is interposed between the pulley O and the shaft 63*c*, and the latter has a development axis a forming with the plane of the platform 10 an angle θ different from 90°, in such a way that a plane comprising the pulley O is incident to the plane of the supporting platform 10. One or two spacer rings 65*c* are also present, which are splined on the shaft 63*c* and placed between the plane of the platform 10 and the pulley O, in such a way to keep the latter in position at a determined height on the shaft 63*c*.

The return cables (160, 260, 360, 460) hence allow an opposite movement of a corresponding finger module, with respect to the movement given by cables (140, 240, 340, 440). Advantageously, the use of an idle pulley D, of idle pulleys with a "plate-shaped" structure E and of idle pulleys with an inclined structure I, also permits to reduce the size of the transmission means of the device 1.

Figure 7:
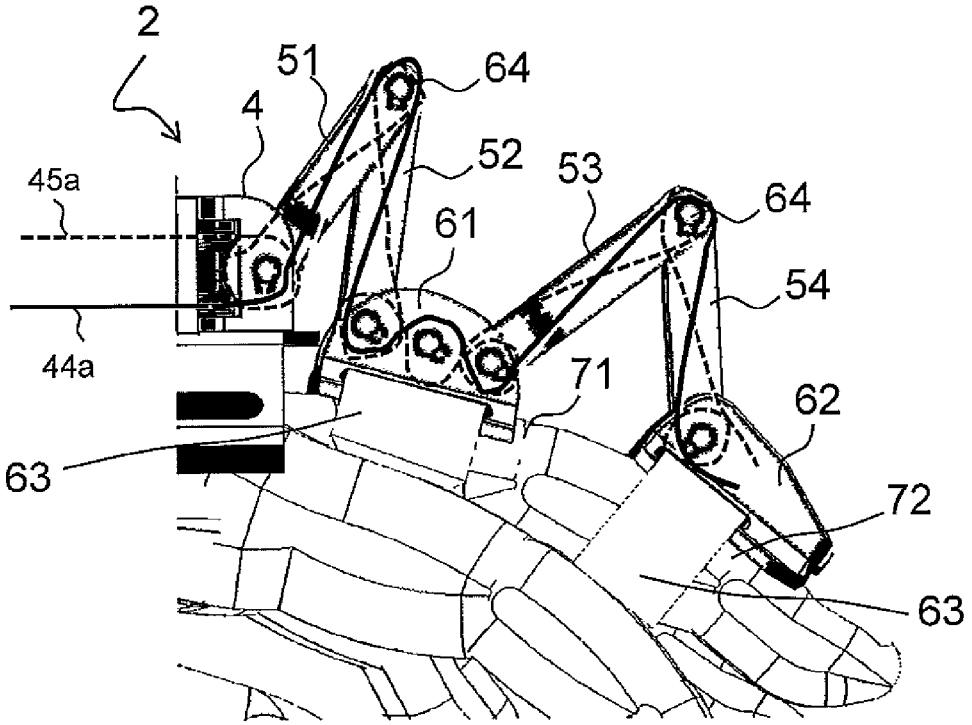
FIG. 7 shows a side view and in a worn condition of a fourth constructive detail—the finger module—of the actuation device according to the invention.
Figure 7A:
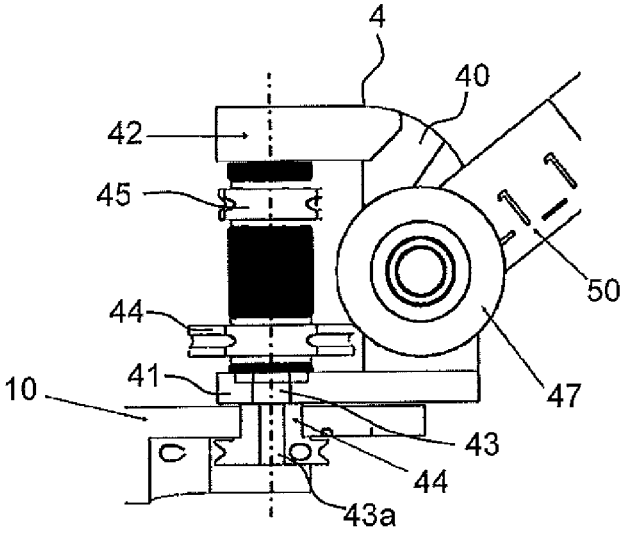
FIGS. 7*a* and 7*b* respectively show a side view and a top view of one enlarged detail of FIG. 7 of the actuating device according to the invention.
Figure 7B:
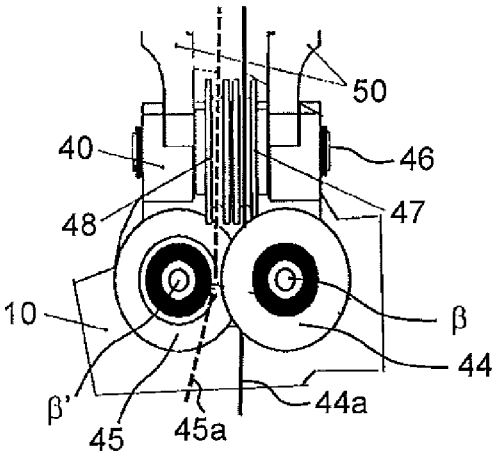

With reference to FIGS. 7, 7*a* and 7*b* the architecture of the finger module 2 is shown, which is identical for each of the four finger modules (2, 2A, 2B, 2C), partially shown in FIG. 1.

The finger module 2 is connected to the supporting platform 10, with an end 21 provided with a joint 4, comprising a central body 40 from which a lower arm 41 and an upper arm 42 depart, substantially mutually parallel. The lower arm 41 lies on the upper surface of the platform 10, and has a housing to allow the fastening of a shaft 43, which crosses the platform 10 and exits from the same, with an end 43*a* on which a pulley 44 is mounted.

This latter is part of a mechanism 7—visible in FIG. 8—able to compensate possible adductive or abductive movements of the finger module 2, and which will be later explained in more detail.

The upper arm 42 and the lower arm 41 are connected with a pair of axes (β,β') orthogonal to the plane of platform 10, each of them providing for an aligning pulley (44, 45) able to couple respectively with a cable 44*a*, intended for the flexion of the finger module, and with a return cable 45*a*, intended on the other hand for its extension.

In fact, the direction of the cable 44*a* and of the return cable 45*a* at the inlet of the finger module 2 can vary with respect to the axis of the finger itself, due to its adduction/abduction movements.

In particular, the two aligning pulleys (44, 45) allow to maintain the cable 44*a* and the return cable 45*a* aligned with respect to the finger module 2, and they are placed at different heights: an upper pulley 45 able to house the return cable 45*a* and with a smaller radius than a lower pulley 44, able to house the cable 44*a* which, once pulled, permits to close the finger module 2. In the other direction, when the return cable 45*a* is pulled, the finger module 2 is extended, and the cable 44*a* is released, to allow its movement.

The central body 40 of the joint 4 is crossed by a shaft 46, on which two pulleys (47, 48) rotate, housing the cables coming from the aligning pulleys (44, 45) respectively. On the shaft 46 is connected with one end and also rotates, a first bar 51 of a connecting mechanism with four bars (51, 52, 53, 54).

The second bar 52 of such mechanism is connected with one end to the free end of the first bar 51, and with the remaining end to a first support element 61, placed on the first phalanges 71 of the finger of the hand. A third bar 53 is connected with one end to the first support element 61, and with the other end to one end of the fourth bar 54, this latter being connected in turn with the remaining end to a second support element 62, placed on the second phalanx 72 of the finger. On the second support element 62 the ends of the two cables (44*a*, 45*a*) are fixed.

Each support element (61, 62) is connected with a corresponding phalanx of the finger, and through removable hooking means 63, for example bands of Velcro, and the bars (51, 52, 53, 54) are mutually connected in a rotatable way, through joints 64 that have pulleys able to allow a path of the cable 44*a* and of the return cable 45*a*, which guide the flexion or extension movement of the finger module 2.

It is appropriate to note that, even in the shown embodiment the finger module 2 assists two phalanges of the finger of the hand, it could be equally possible to assist just one or all three phalanges, and they provide for a support element for each phalanx.

Figure 8:
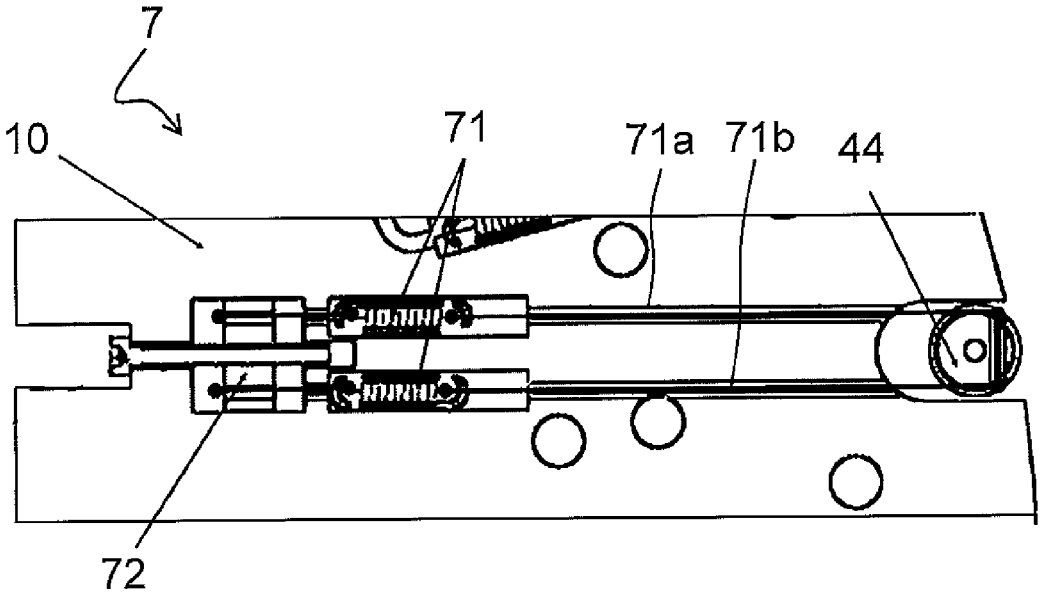
FIG. 8 shows a bottom view of a fifth constructive detail of the actuation device according to the invention.

With reference to FIG. 8, in order to improve the adaptability of device 1 during a grasping phase, each finger module provides for a mechanism 7 with passive elements.

The mechanism 7 comprises the pulley 44, rigidly connected to the joint 4, and two counter springs 71. Each spring 71 is connected by a corresponding cable (71*a*, 71*b*) to the pulley 44, and the ends of each cable connected to the pulley 44, are fastened on the same in a rigid way.

The mechanism allows to adapt the finger module 2 to the adduction/abduction movement of the joint 4, during a grasping gesture of the hand, by guiding the return to a resting position of the finger module 2, thanks to springs 71. In fact, when the joint 4 rotates, the springs 71 modify their length, in particular, the one by increasing and the other by shortening its length, in such a way to generate a return pair to the resting position. The mechanism 7 also comprises a tensioning element 72, which allows to adjust the strength of each spring 71.

Figure 9:
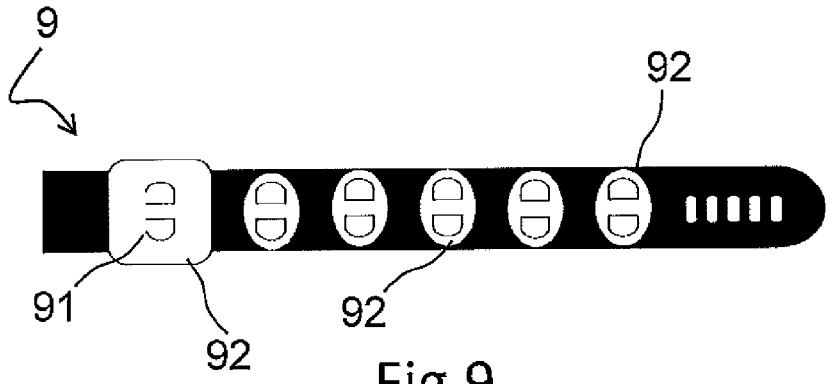
FIG. 9 shows a top view of a sixth detail—the band with a system of electromyographic control—of the actuation device according to the invention.

In FIG. 9, an outline of a band 9 is shown, able to be placed around the forearm of the user wearing the device 1, and which comprises an electromyographic control unit 91, connected with the motor 11, to actuate the device 1 itself.

In the shown example, the band 9 comprises six electrodes 92, one of which comprises the control unit 91 that, through a calibration procedure, permits to individuate two groups of electrodes, respectively connected to muscles guiding the extension or flexion of the fingers of the hand.

In particular, when the myoelectric signal linked to the flexion of fingers and detected by a corresponding group of electrodes exceeds a predetermined threshold, it means that the user has started a closing movement of his hand.

Consequently, the control unit 91 sends a speed signal to the motor 11, which generates a torque producing a closing force, i.e. the input force on finger modules 2. Such closure force is transmitted by the motor 11 to finger modules 2, independently from the kind of the geometry of an object to grasp.

Furthermore, the closure force is transmitted to the finger modules 2, even if, after the actuation of the device 1, the electromyographic signal detected by electrodes 92 is zero. In other words, it is not necessary that the user wearing the device 1 exerts continuously a grasping force in order to hold the contribution of the device 1 for the closure of the hand.

When, on the contrary, the user actuates the muscles guiding the extension of the fingers of the hand, the corresponding electrode group detects this activity, and the closing force transmitted to the finger modules decreases, and changes its sign, in order to help the extension of fingers.

From the above description, it is clear that the described reduction device allows to reach the proposed purposes.

So, it is clear to a technician of the field that it is possible to modify and vary the described solution, with reference to the Figures cited above, without in any case departing from the scope of the present document, as defined in the annexed claims.

The invention claimed is:

1. A wearable actuation device (1) for the assisted movement of fingers of a user's hand, comprising:

a supporting platform (10) intended to be positioned on the back of the hand and provided with fixing means for wearing in a removable way the device (1) on the hand, an articulated first finger module (2), connected with one end to the supporting platform (10) and suitable to be positioned and connected to a finger of the hand for guiding a movement of flexion or extension of the finger itself, a motor (11) provided with an output shaft, supported by the supporting platform (10) and suitable to generate a rotational motion in two opposite directions of the motor shaft (11), first transmission means of the first finger module (2) to allow an actuation of the first finger module (2), said transmission means comprising:

a first movable member (13) displaceable at least in translation in two opposite directions, an actuation flexible element (12) coupled with the movable member (13) and wrapped on a motor pulley (111) connected to the motor shaft (11), characterized in that the actuation flexible element (12) is coupled with the first movable member (13), said first movable member (13) comprising an upper pulley (130) and a lower pulley (131) axially connected through a pin (132) interposed between the upper (130) and lower (131) pulley and comprising a slider (135), coupled with said pin (132) in a freely rotatable way and fixed to the actuation flexible element (12), so as to move said first movable member (13) in the two opposite directions depending on the rotation direction of the motor shaft (11), and in that said first transmission means also comprising a pair of cables formed by a main cable (140) and a return cable (160) both coupled at one end thereof to the first finger module (2) and at their other end to the first movable member (13) in such a way that to a translation in a direction of the first movable member (13) corresponds a movement of the main cable (140) and of the return cable (160) to which corresponds the actuation in flexion or extension of the first finger module (2), depending on the rotation direction of the motor shaft (11).

2. A device (1) according to claim 1, wherein the first transmission means further comprise a return pulley (15) around which the actuation flexible element (12) is wrapped, said first movable member (13) being fixed at opposite sides to the actuation flexible element (12), so as to be moved in a direction or in the opposite direction depending on the rotation direction of the motor pulley (111).

3. A device (1) according to claim 1, wherein said upper pulley (130) and said lower pulley (131) are each provided with guides (134*a*, 134*b*) suitable to accommodate said main cable (140) and said return cable (160) respectively, and wherein said main cable (140) and said return cable (160) are each wrapped around the corresponding upper (130) and lower (131) pulley, such that a rotation of said movable member (13) around an axis of rotation passing through the pin (132) follows a wrapping of the main cable (140) and an unwinding of the return cable (160) or vice versa.

4. A device (1) according to claim 1, comprising a second finger module (2A) and second transmission means of the second finger module (2A) to allow an actuation of the second finger module (2A), said second transmission means comprising: -a second movable member (23) displaceable at least in translation in two opposite directions, -a second actuation flexible element (141, 161) coupled to the second movable member (23) and to said first movable member (13), so as to move the second movable member (23) in the two opposite directions depending on a displacement in two opposite directions of the first movable member (13) and wherein the second transmission means also comprise a pair of cables formed by a main cable (240) and a return cable (260) both coupled at one end thereof to the second finger module (2A) and at their other end to the second movable member (23) in such a way that to a translation in a direction of the second movable member (23) corresponds a movement of the main cable of the second transmission means (240) and/or of the return cable of the second transmission means (260) to which corresponds the actuation in flexion or extension of the second finger module (2A), depending on the displacement direction of the first movable member (13).

5. A device (1) according to claim 4, wherein the second movable member (23) comprises: an upper pulley (130) and a lower pulley (131) axially connected through a pin (132) interposed between the upper (130) and lower (131) pulley, a slider (135), coupled to said pin (132) in a freely rotatable way and fixed to the second actuation flexible element (141, 161), wherein the upper (130) and lower (131) pulley of the second movable member are each provided with guides (134*a*, 134*b*) suitable to accommodate said main cable of the second transmission means (240) and said return cable (260) of the second transmission means respectively, wherein said main cable of the second transmission means (240) and said return cable of the second transmission means (260) are each wrapped around the corresponding upper (130) and lower (131) pulley of the second movable member, such that a rotation of said second movable member (23) around an axis of rotation passing through the pin (132) of the second movable member follows a wrapping of the main cable (240) of the second transmission means and an unwinding of the return cable (260) of the second transmission means or vice versa.

6. A device (1) according to claim 4, comprising a third and a fourth finger module (2B,2C) and third transmission means of the third and the fourth finger module (2B,2C) to allow an actuation of the third and/or the fourth finger module (2B,2C), said third transmission means comprising: -a third movable member (33) displaceable at least in translation in two opposite directions, -a third actuation flexible element (241, 261) coupled to the third movable member (33) and to the second movable member (23), so as to move the third movable member (33) in the two opposite directions depending on a displacement in two opposite directions of the second movable member (23) and wherein the third transmission means also comprise at least two pairs of cables formed by main cables (340, 440) and return cables (360, 460) both cables of each pair being coupled at one end thereof with the third and/or the fourth finger module (2B, 2C) and at their other end to the third movable member (33) in such a way that to a translation in a direction of the third movable member (33) corresponds a movement of the main cables (340, 440) of the third transmission means and/or of the return cables (360, 460) of the third transmission means to which corresponds the actuation in flexion or extension of the third and/or the fourth finger module (2B, 2C), depending on the displacement direction of the second movable member (23).

7. A device (1) according to claim 6, wherein the third movable member (33) comprises an upper pulley (130) and a lower pulley (131) axially connected through a pin (132) interposed between the upper (130) and lower (131) pulley, a slider (135), coupled to said pin (132) in freely rotatable way and fixed to the third actuation flexible element (241, 261), wherein the upper (130) and lower (131) pulley of the third movable member are each provided with guides (134*a*, 134*b*) suitable to accommodate said main cables (340, 440) of the third transmission means and said return cables (360, 460) of the third transmission means respectively, wherein said main cables of the third transmission means (340, 440) and said return cables (360, 460) of the third transmission means are each wrapped around the corresponding upper (130) and lower (131) pulley of the third movable member, such that a rotation of said third movable member (33) around an axis of rotation passing through the pin (132) of the third movable member follows a wrapping of the main cables of the third transmission means (340, 440) and an unwinding of the return cables (360, 460) of the third transmission means or vice versa.

8. A device (1) according to claim 6, wherein each finger module (2, 2A, 2B, 2C) comprises an articulated bar mechanism comprising: -a first supporting element (61) provided with fixing means configured for attachment with a phalanx of the user's finger, -a first bar (51) connected at a first end to the supporting platform through a joint (4) having two degrees of freedom that allow the rotation of the first bar (51) around two axes substantially perpendicular to each other, one of which is substantially perpendicular to the platform (10) and the other lies in a plane substantially parallel to that of the platform (10), -a second bar (52) with a first articulated end having at least one degree of freedom to a second free end of the first bar (51) and with a second articulated end having at least one degree of freedom to the first supporting element (61).

9. A device (1) according to claim 8, wherein each finger module (2) also comprises-a second supporting element (62) provided with a second fixing means configured for attachment with a phalanx of the user's finger, -a third bar (53) connected with a first articulated end having at least one degree of freedom to the first supporting element (61), -a fourth bar (53) connected with a first articulated end having at least one degree of freedom to the second end of the third bar (53) and with a second articulated end having at least one degree of freedom to the second supporting element (62).

10. A device (1) according to claim 9, wherein on the first supporting element or on the second supporting element (62) of each finger module are fixed ends of the main cables (140, 240, 340, 440) and of the return cables (160, 260, 360, 460) of each respective transmission means, arranged on opposite sides with respect to a fulcrum of articulation respectively of the second bar (52) with the first supporting element (61) or of the fourth bar (54) with the second supporting element (62), so that as a result of a drive in traction of the main cables (140, 240, 340, 440) or of the return cables (160, 260, 360, 460) of each respective transmission means are provided the movements of flexion and extension of each finger module (2).

* * * * *